US008558651B2

(12) United States Patent
Suzuki

(10) Patent No.: US 8,558,651 B2
(45) Date of Patent: Oct. 15, 2013

(54) CORE FIXING MEMBER AND COIL DEVICE

(75) Inventor: Kotaro Suzuki, Kumagaya (JP)

(73) Assignee: Tamura Corporation, Tokyo (JP)

( * ) Notice: Subject to any disclaimer, the term of this patent is extended or adjusted under 35 U.S.C. 154(b) by 0 days.

(21) Appl. No.: 13/283,845

(22) Filed: Oct. 28, 2011

(65) Prior Publication Data

US 2012/0194311 A1 Aug. 2, 2012

(30) Foreign Application Priority Data

Jan. 27, 2011 (JP) ..... 2011-015781

(51) Int. Cl.

| | |
|---|---|
| ***H01F 27/06*** | (2006.01) |
| ***H01F 27/02*** | (2006.01) |
| ***H01F 27/28*** | (2006.01) |
| ***H01F 27/24*** | (2006.01) |

(52) U.S. Cl.

USPC ..... 336/67; 336/65; 336/90; 336/92; 336/182; 336/184; 336/212

(58) Field of Classification Search

USPC ..... 336/90, 92, 107, 178, 55, 59–61, 212, 336/192, 210, 221, 65, 67, 182, 184

See application file for complete search history.

(56) References Cited

U.S. PATENT DOCUMENTS

| | | | | |
|---|---|---|---|---|
| 2,587,097 | A * | 2/1952 | Berlant | 360/125.01 |
| 3,110,873 | A * | 11/1963 | Mittermaier | 336/210 |
| 3,144,503 | A * | 8/1964 | Fischer | 174/535 |
| 4,055,826 | A * | 10/1977 | Franz | 336/100 |
| 4,475,097 | A * | 10/1984 | Kikuchi | 336/192 |
| 5,898,354 | A * | 4/1999 | Lee | 336/96 |
| 7,961,070 | B2 | 6/2011 | Suzuki et al. | |
| 2009/0108971 | A1* | 4/2009 | Okamoto | 336/65 |
| 2010/0102912 | A1* | 4/2010 | Suzuki et al. | 336/65 |
| 2012/0126928 | A1* | 5/2012 | Yoshikawa et al. | 336/221 |

FOREIGN PATENT DOCUMENTS

| | | |
|---|---|---|
| JP | 2009-26952 | 2/2009 |
| JP | 2010-123927 | 6/2010 |

* cited by examiner

*Primary Examiner* — Mohamad Musleh
*Assistant Examiner* — Mangtin Lian
(74) *Attorney, Agent, or Firm* — McCarter & English, LLP

(57) ABSTRACT

A core fixing member including: a core fixing part that has a plate-like shape and is to be fixed to a core; a case fixing part that has a plate-like shape and is to be fixed to a case; and at least one an arm part connecting the case fixing part with the core fixing part, and wherein the core fixing part and the case fixing part are arranged in a same plane, and the at least one arm part is formed in a shape of a letter 'U', and one end of the at least one arm part is connected to the core fixing part and the other end of the at least one arm part is connected to the case fixing part.

18 Claims, 6 Drawing Sheets

CORE FIXING MEMBER AND COIL DEVICE

This application claims priority under 35 U.S.C. 119(a) of Japanese Patent Application No. 2011-015781, filed on Jan. 27, 2011.

BACKGROUND OF THE INVENTION

The present invention relates to a coil device having a core, and a core fixing member for fixing a core to a case of the coil device.

A reactor is a passive element which gives an inductive reactance to an alternating component of a signal, and is used, for example, in an inverter circuit, an active filer circuit or a DC step-up circuit. A reactor is also used for a DC step-up and step-down converter which is a key device of a driving system in a hybrid vehicle or an electric vehicle which has been brought in practical use in recent years. In general, a reactor having a relatively large capacity used for an electric vehicle is configured such that a core which is a magnetic material formed in a ring shape and a coil wound around the core are accommodated in a radiation case. In order to prevent magnetic saturation, in general, a structure (a divided core structure) in which the core is divided into a plurality of pieces arranged in a plane which is perpendicular to a magnetic flux and a gap member is inserted into a space between the divided surfaces to adhere the divided pieces to each other is employed.

Since the core generates heat due to an energy loss, such as an iron loss, it is important to secure sufficient heat conduction from the core to the radiation case. Furthermore, regarding a reactor used for a DC step-up and step-down converter, vibration and noise are caused by magnetostriction of the core or the electromagnetic attraction because charge and discharge of the energy are repeated. When a divided core is used, the vibration strongly occurs particularly in a direction perpendicular to the gap surface of the divided core.

Japanese Patent Provisional Publication No. 2010-123927A (hereafter, referred to as patent document #1) discloses a fixing member of a leaf spring type configured to hold tightly a core in a radiation case. The fixing member, which is made from a metal plate and is elastically deformable, presses the core against bottom and side faces in the inside of the radiation case. By employing such a fixing structure (a metal touch structure) for causing the core to closely contact the radiation case, it becomes possible to secure a suitable heat radiation property. However, in the reactor having the metal touch structure, the core directly contacts the radiation case. Therefore, in this case, the vibration caused by the core propagates to the case without attenuation, and thereby a relatively large noise is caused at the time of activation.

Japanese Patent Provisional Publication No. 2009-26952A (hereafter, referred to as patent document #2) proposes a fixing structure (a floating structure) in which a core is supported with a stay without contacting a radiation case. A conventional stay disclosed in patent document #2 is formed by bending a slender rectangular metal plate in a shape of a letter 'L'. The core is configured by divided core pieces (magnetic materials) which are arranged in a shape of a ring and are integrally coated with resin by injection molding. At the time of injection molding (insert molding), an end of the stay is buried in the resin coating the core and is fixed to the core. Furthermore, the other end of the stay is provided with a fixing part having a shape of a flat clip plate so that, by fixing the fixing part to the radiation case with a bolt, the reactor body is fixed to the radiation case via the stay in the state where the reactor body floats from the radiation case. Since such a fixing structure does not cause the core to directly contact the radiation case, it becomes possible to reduce the vibration propagating from the core to the radiation case and thereby to reduce the noise caused by the reactor.

SUMMARY OF THE INVENTION

However, the stay disclosed in patent document #2 has a drawback that since an elastically deformable part (i.e., a part connecting the fixing part with the part of the core buried in the coating) is short, the rigidity is large and thereby it becomes impossible to sufficiently secure the vibration releasing effect by the elasticity of the spring. Furthermore, the number of components installed during the insert molding is large, and a high degree of installation accuracy is required. Therefore, a set up process for the insert molding becomes complicated and requires caution. As a result, the set up for the insertion molding requires a considerably long work time, and processing cost also becomes high.

However, a fixing structure for solving simultaneously both of the problem in regard to the conventional floating structure which is advantageous for the noise and vibration performance (i.e., the problem that the vibration relaxation property by the elasticity of the spring is insufficient) and the problem that the excessively complex work is required for attaching of the core has not ever been proposed.

The present invention is made in consideration of the above described circumstances. The present invention is advantageous in that it provides a core fixing member and a coil device capable of suitably achieving the vibration relaxation effect without requiring an excessively complicated work.

According to an aspect of the invention, there is provided a core fixing member for fixing a core of a coil device body to a case to accommodate the coil device body in the case in a non-contact manner. The core fixing member includes: a core fixing part that has a plate-like shape and is to be fixed to the core; a case fixing part that has a plate-like shape and is to be fixed to the case; and at least one an arm part connecting the case fixing part with the core fixing part. In this configuration, the core fixing part and the case fixing part are arranged in a same plane, and the at least one arm part is formed in a shape of a letter 'U', and one end of the at least one arm part is connected to the core fixing part and the other end of the at least one arm part is connected to the case fixing part.

With this configuration, since the core fixing part can be connected with the case fixing part with a relatively long arm part, suitable vibration relaxation effect can be obtained. Furthermore, since a high degree of relative position accuracy can be obtained between the core fixing part and the case fixing part, it is possible to easily and accurately position the core with respect to the case.

In at least one aspect, the core fixing member may be made from a sheet of metal plate.

In at least one aspect, the at least one arm part may have a pair of projections formed to project in a direction perpendicular to an arrangement direction in which the core fixing part and the case fixing part are arranged. With this configuration, it becomes possible to lengthen the arm part. Therefore, the vibration relaxation effect can be enhanced.

In at least one aspect, the at least one arm part may be formed such that the pair of projections are bent at a predetermined angle with respect to the same plane in which the core fixing part and the case fixing part are arranged. With this configuration, it becomes possible to reduce a projected area of the core fixing member to the same plane and thereby to reduce the size of the coil device.

In at least one aspect, the at least one arm part may be formed such that the pair of projections are bent at an approximately right angle with respect to the same plane in which the core fixing part and the case fixing part are arranged. Since the projections are bent at an approximately right angle, the projections are hard to interfere with other components and the other parts of the core fixing member. As a result, it becomes possible to further easily reduce the size of the coil device.

In at least one aspect, the at least one arm part may have a same width at bending portions of the pair of projections. With this configuration, the amounts of springback caused at the two bending portions during the bending process become substantially the same. Therefore, it becomes possible to enhance the relative position accuracy between the core fixing part and the case fixing part. As a result, it becomes possible to accurately position the core with respect to the case.

In at least one aspect, each of the core fixing part and the case fixing part may have a recessed part having a curved contour at a connecting portion with respect to the at least one arm part. With this configuration, it becomes possible to prevent concentration of the stress to the portion around the root of the arm art, and thereby to prevent the core fixing part and the case fixing part from being damaged.

In at least one aspect, the at least one arm part may include a pair of arm parts. In this case, the core fixing part is connected with the case fixing part by the pair of arm parts arranged to be sandwiched by the core fixing part and the case fixing part. With this configuration, the relative position accuracy between the core fixing part and the case fixing part. Furthermore, since the rigidity of the core fixing member can be enhanced, the core fixing member can be suitably used for a coil device having a heavy weight.

In at least one aspect, each of the core fixing part and the case fixing part may have a through hole formed therein for bolting.

According to another aspect of the invention, there is provided a coil device, including: a coil device body having a core; a case in which the coil device body is accommodated in a non-contact manner; and one the above described core fixing members provided to fix both ends of the core to the case.

With this configuration, propagation of the high frequency vibration with an audible frequency caused in the core to the case can be reduced, and therefore the noise caused during activation of the coil device can be reduced. Since propagation of a shock applied from the outside to the case with respect to the case can also be reduced, crashproof of the coil device can also be enhanced. By using the core fixing member having the excellent relative position accuracy between the core fixing part and the case fixing part, it becomes possible to accurately attach the core to the case. As a result, it becomes possible to set the gap between the coil device body and the case to be small, and thereby to realize the coil device which is compact in size and has the excellent heat radiation property. In particular, the extremely excellent heat radiation property can be realized in the configuration where the heat radiation case having an suitable thermal conductivity is used and the gap between the heat radiation case and the coil device body is filled with the filler.

In at least one aspect, the core may be provided with a pair of nuts for bolting the core fixing part, at both ends thereof in a certain direction. The core is formed to continuously extend between the pair of nuts. With this configuration, since a force applied to the core from the core fixing part propagates in the core as a compressive force or a tensile force, ne shear force is caused in the core. By employing such a configuration when a core having a weak shear strength, such as a dust core, is used, it becomes possible to effectively prevent a crack from occurring in the core.

BRIEF DESCRIPTION OF THE ACCOMPANYING DRAWINGS

Figure 7:
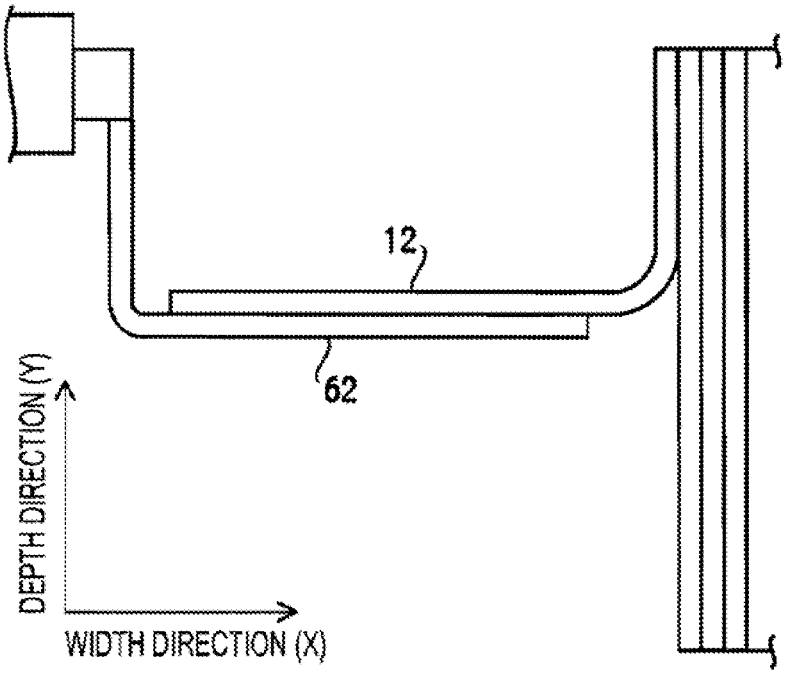

FIG. 7 generally illustrates an arrangement of a bus bar of a terminal base and a lead of the coil according to the embodiment.

Figure 8:
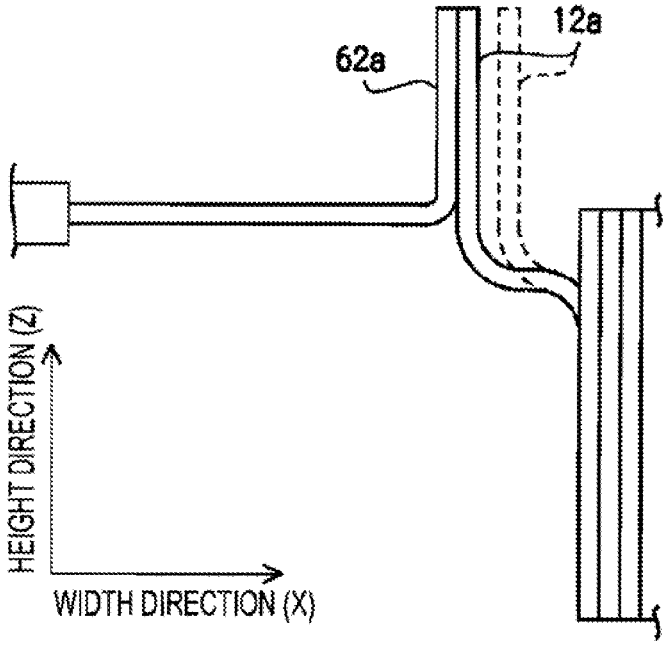

FIG. 8 illustrates another example an arrangement of a bus bar and a lead according to the embodiment of the invention.

Figure 9:
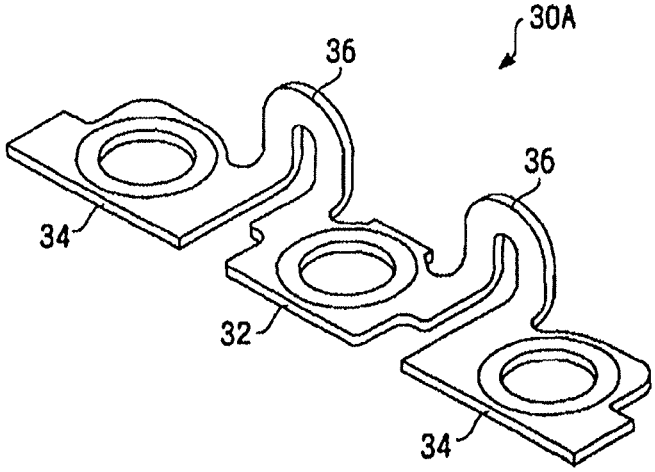

FIG. 9 is a perspective view illustrating a variation of the core fixing member according to the embodiment.

Figure 10:
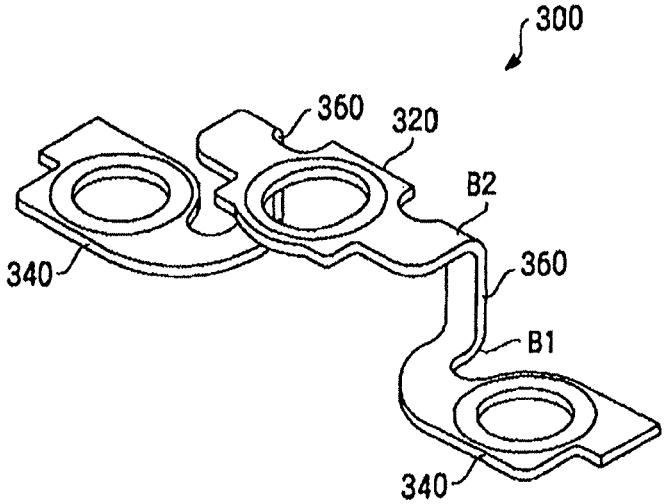
RELATED ART FIG.10

FIG. 10 illustrates a configuration of a core fixing member according to a comparative example.

DETAILED DESCRIPTION OF THE EMBODIMENTS

Hereinafter, an embodiment according to the invention are described with reference to the accompanying drawings.

Figure 1:
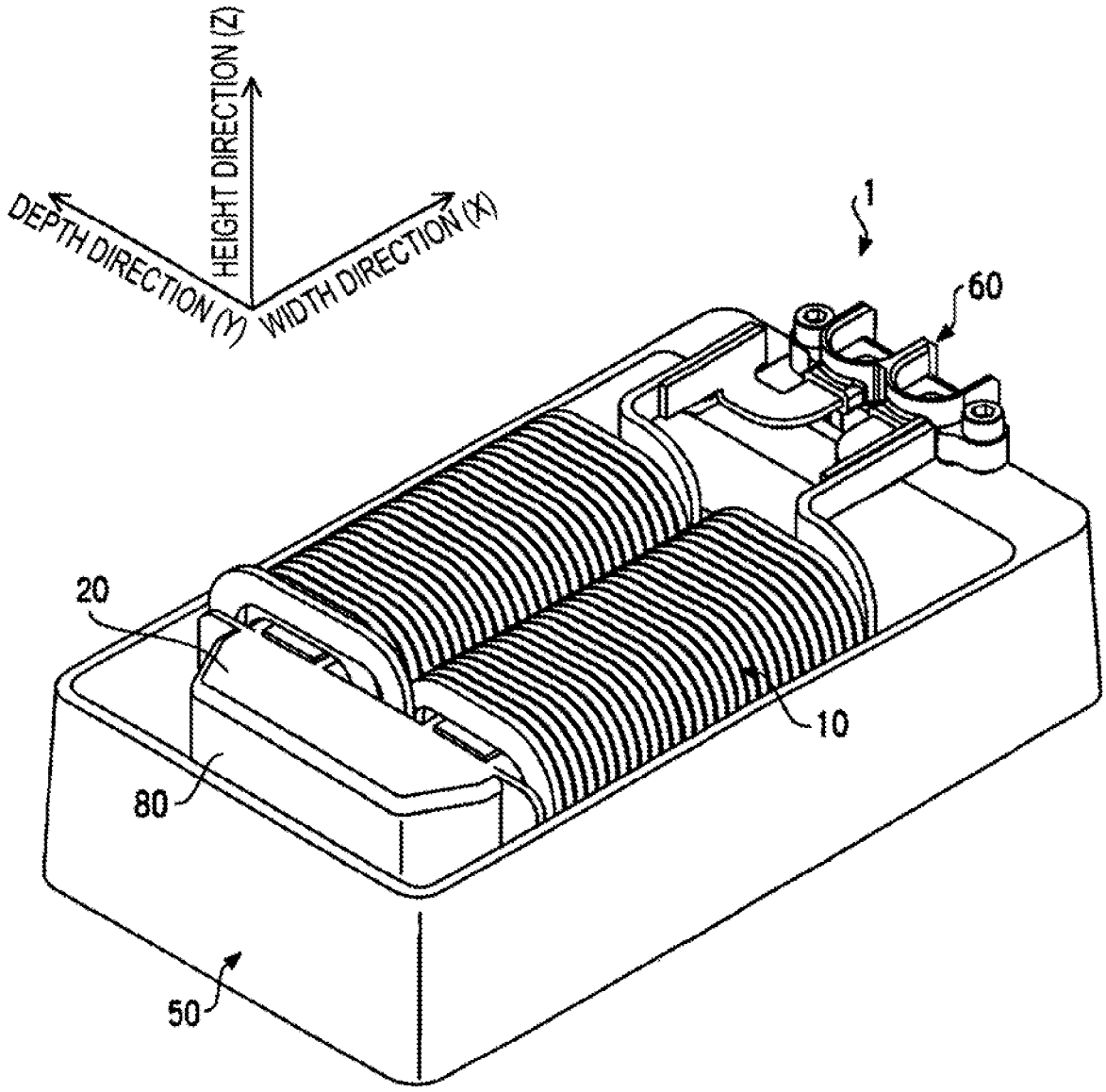
FIG. 1 is a perspective view of a reactor according to an embodiment of the invention.
Figure 2:
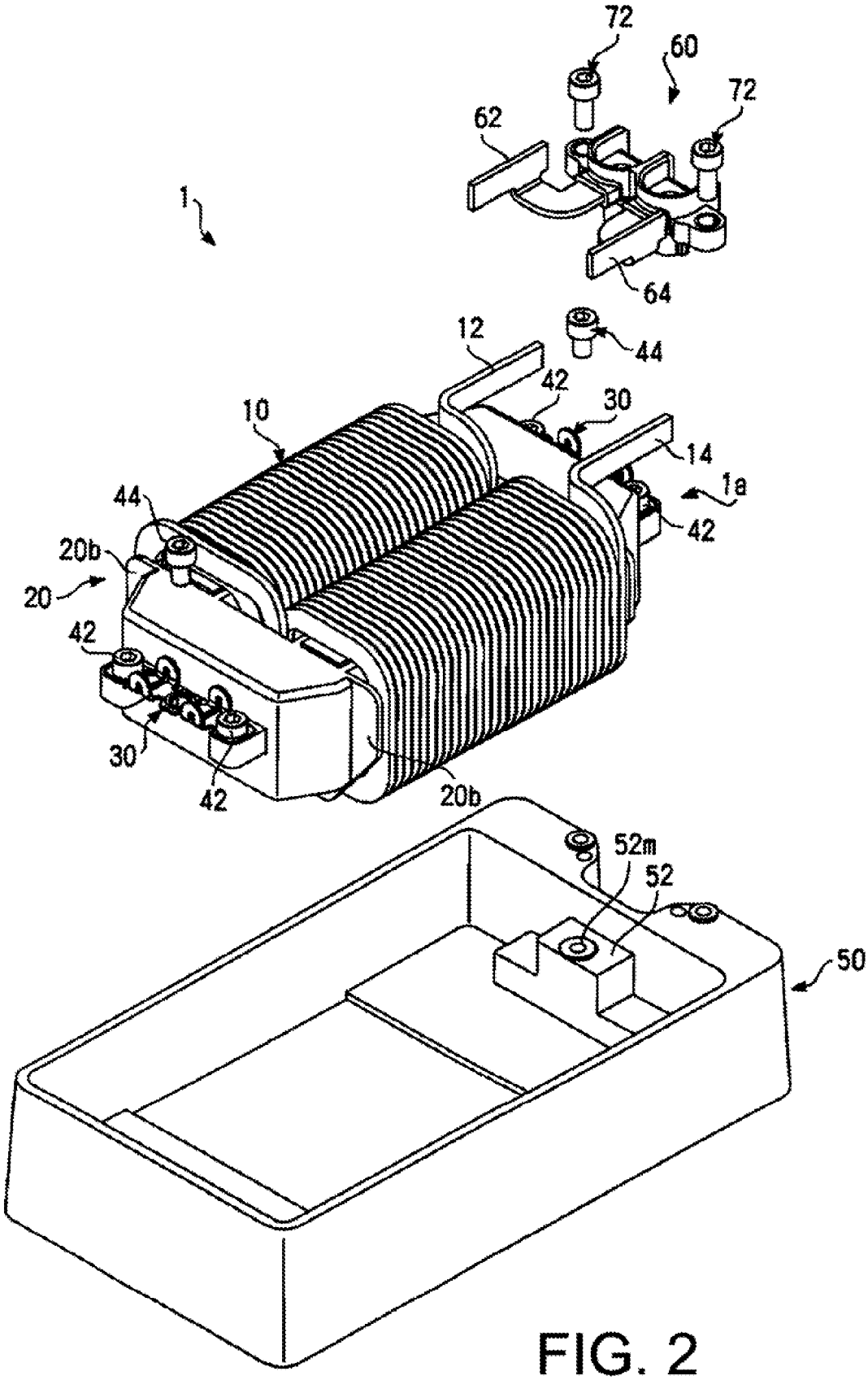
FIG. 2 is an exploded view of the reactor.

FIG. 1 is a perspective view of a reactor 1 according to the embodiment of the invention. FIG. 2 is an exploded view of the reactor 1. In the following, a direction pointing from the lower left part to the upper right part on FIG. 1 is defined as a width direction (X axis direction), a direction pointing from the lower right part to the upper left part on FIG. 1 is defined as a depth direction (Y axis direction), and a direction pointing from the lower side to the upper side is defined as a height direction (Z axis direction) for convenience of explanation. When the reactor 1 is used as a component in an apparatus, the reactor 1 may be oriented in any direction.

As shown in FIGS. 1 and 2, the reactor 1 includes a reactor body 1*a* having a coil 10 and a core 20, a radiation case 50, a core fixing member 30 and a terminal base 60. The reactor body 1*a* is accommodated in the radiation case 50, and a gap in the radiation case 50 is filled with a filler 80.

Figure 3:
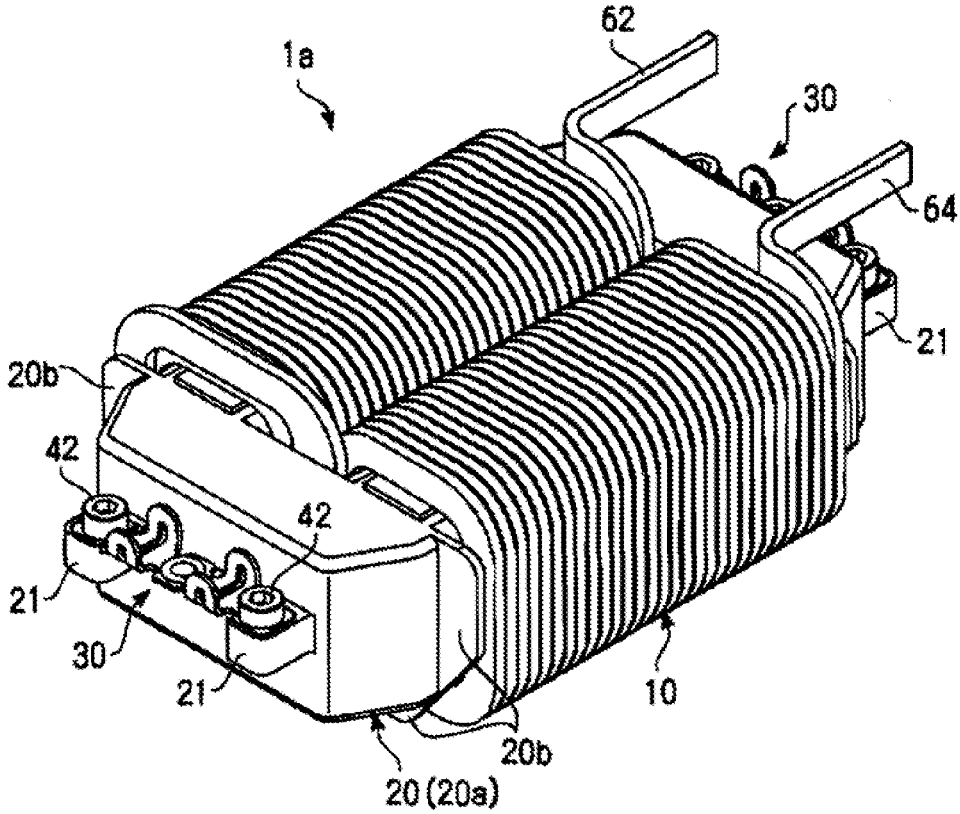
FIG. 3 is a perspective view of a reactor body illustrating a state before the reactor body is accommodated in a radiation case.
Figure 4:
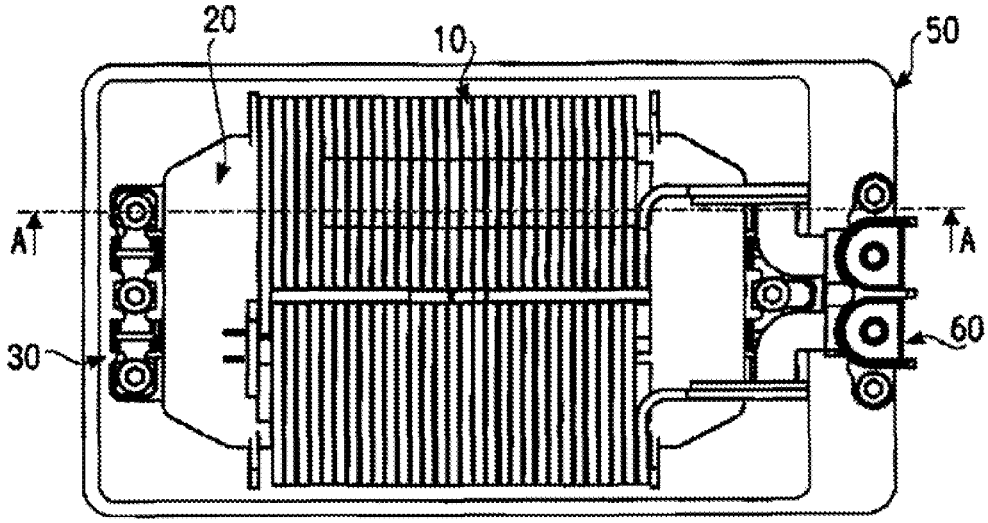
FIG. 4 is a plan view of the reactor.
Figure 5:
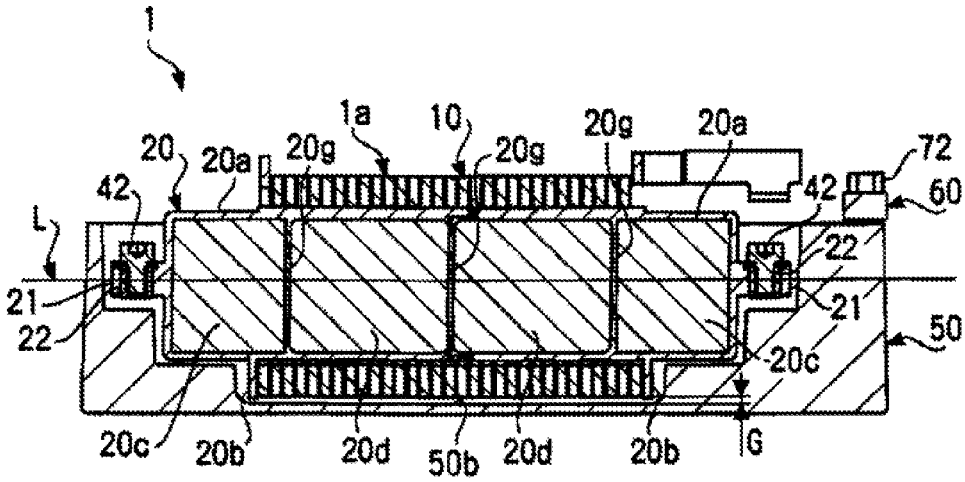
FIG. 5 is a cross sectional view viewed along a line A-A in FIG. 4.

FIG. 3 is a perspective view of the reactor body 1*a* illustrating a state before the reactor body 1*a* is accommodated in the radiation case 50. FIG. 4 is a plan view of the reactor 1. FIG. 5 is a cross sectional view viewed along a line A-A in FIG. 4.

The core 20 is a ring core formed such that tip ends of two U-shaped core units 20*a* are attached to each other to form a shape of a letter 'O' via gap members 20*g* (see FIG. 5). The gap member 20*g* is a plate-like member made of alumina having a certain thickness. As the gap member 20*g*, a member made of various types of nonmagnetic ceramics or resin may be used.

The U-shaped core unit 20*a* is formed such that a plurality of magnetic core pieces 20*c* are stacked via the gap members 20*g* to have a shape of a letter 'U' and the stacked core pieces 20*c* are coated with resin through the injection molding (insertion molding). As a coating resin material of the U-shaped core unit 20*a*, heat-resistant resin, such as poly phenylene sulfide (PPS), is used. Although, in this embodiment, a powder magnetic core is used for each core piece 20*c*, silicone sheet steel or ferrite may be used for each core piece 20*c*.

As shown in FIGS. 3 and 5, a pair of brackets 21 for attaching the core fixing member 30 are formed on the U-shaped core unit 20*a*. In each bracket 21, a nut 22 is buried through the insertion molding.

The coil 10 is formed such that two winding parts which are formed with rectangular enamel wires and have the same structure are arranged in parallel with each other, and the beginning parts of the wires (the left ends in FIG. 4)*are* connected to each other. By inserting the two parallel straight parts of each U-shaped core unit 20*a* into hollow parts of the two winding parts of the coil 10, letting the tip ends of the two U-shaped core units 20*a* to contact each other, and adhering the tip ends to each other via the gap member 20*g*, the reactor body 1*a* is formed. As shown in FIGS. 3 and 5, projections 20*b* are formed on the side face and the lower face of each U-shaped core unit 20*a*.

Figure 6:
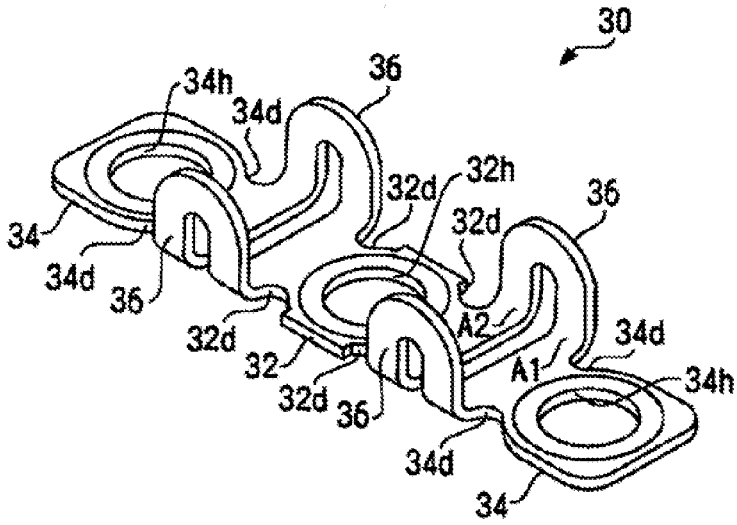
FIG. 6 is a perspective view of a core fixing member according to the embodiment.

FIG. 6 is a perspective view of the core fixing member 30. The core fixing member 30 is a member for attaching the reactor body 1*a* to the radiation case 50 at both ends in the X axis direction. The core fixing member 30 is formed through the sheet metal processing for a stainless steel plate. The core fixing member 30 includes a case fixing part 32 which is fixed to the radiation case 50 with a bolt, two core fixing parts 34 which are fixed to the core 20 with a bout, and two pairs of U-shaped slender arms 36 which connect the case fixing part 32 with the core fixing parts 34. The core fixing member 30 is formed by punching out it from a stainless steel plate and thereafter bending, at an approximately right angle, the two pairs of arms 36 at connecting portions between the core fixing parts 34 and the case fixing part 32. The two bending parts of each arm 36 are aligned in a line, and are simultaneously formed in one bending process. The two arms 36 aligned in the Y axis direction are located such that all the bending parts thereof are aligned in a line, and can be formed simultaneously in one bending process.

The case fixing part 32 and the core fixing parts 34 are formed as plate-like parts arranged in a line in a same plane. Through holes 32*h* and 34*h* are formed in the case fixing part 32*h* and the core fixing part 34, respectively. The two core fixing parts 34 are provided at both ends in the Y axis direction of the case fixing part 32, respectively. Each core fixing part 34 is connected to the case fixing part 32 via a pair of arms 36.

To both ends in the X axis direction of the end parts in the Y axis direction of the case fixing part 32, ends of the arms 36 are connected respectively. To both ends in the X axis direction of an end part in the Y axis direction of each core fixing part 34, the other ends of the arms 36 are connected respectively.

In the case fixing part 32 and the core fixing part 34, recessed parts 32*d* and 34*d* are formed, respectively, around the connecting parts with the arms 36. Each of the recessed parts 32*d* and 34*d* has an outer shape having a gentle curve. By reducing concentration of a stress to a portion around the connecting part with the arm 36, each recessed part enhances the strength of the core fixing member 30.

The arms 36 are plate-like parts arranged to be parallel with the YZ plane, and are bent at a right angle on the upper side around the connecting parts with the case fixing part 32 and the core fixing part 34. Although, in this embodiment, the arm 36 is cut out in a shape of a letter U, the arm 36 may be cut out in another shape as long as the arm 35 is formed in a slender strip shape. By forming the arm 36 to have a slender strip shape, the rigidity of the arm 36 can be reduced, and thereby the effect of reducing the vibration and shock by the spring elasticity of the arm can be enhanced.

As described above, by using the core fixing member 30 according to the embodiment, it becomes possible to enhance the heat radiation property of the reactor 1 and the downsizing of the reactor 1 can be achieved. Hereafter, such advantages are explained in detail.

As shown in FIG. 5, the reactor 1 according to the embodiment has the floating structure in which the reactor body 1*a* is supported not to contact the radiation case 50. The major part of the heat caused by the core 20 at the time of activation propagates to the coil 10 and the radiation case 50 via the filler 80 with which the gap between the coil 10 and the radiation case 50 is filled, and is released to the outside. As the filler 80, resin having a relatively excellent thermal conductivity is used. The gap filled with the filler 80 is a portion where the heat conducting speed becomes lowest in a heat radiation path, and the thickness of a filler layer dominates the heat radiation property of the reactor 1. Therefore, in order to enhance the heat radiation property of the reactor 1, it becomes necessary to set the gap between the coil 10 and the radiation case 50 as small as possible. The design value of the gap G between the coil 10 and the radiation case 50 is determined by parameters including the size accuracy of each component, the assembling accuracy and the deviating amount of the core 30 caused by the vibration in an operating state and the shock applied from the outside. Of these parameters, the size accuracy of the core fixing member 30 formed by the sheet metal processing having a low degree of processing accuracy is a main factor of causing the design value of the gap G between the coil 10 and the radiation case 50 to become large. The low degree of processing accuracy of the sheet metal processing is caused mainly by the springback at the time of a bending process.

In order to demonstrate that the configuration of the core fixing member 30 according to the embodiment of the invention is advantageous in achieving a high degree of size accuracy, a comparative example is explained hereafter. FIG. 10 illustrates a configuration of a core fixing member 300 according to the comparative example. Similarly to the core fixing member 30 according to the embodiment, the core fixing member 300 is configured such that a case fixing part 320 is connected to core fixing parts 340 via arms 360 each having a shape of a slender strip. Therefore, an excellent property of reducing the vibration can be achieved. Furthermore, since the core is fixed using the core fixing member 300 which has a fixed shape and has a certain degree of size accuracy without almost no deformation, the core can be fixed to the radiation case with a considerably higher position accuracy in comparison with the case in which the core is pinched with a leaf sprint type core fixing member. However, the case fixing part 320 and the core fixing part 340 are connected to each other via two bending processing parts B1 and B2, and a sum of processing errors of the two bending processing parts B1 and B2 leads to an error of the relative position of the case fixing part 320 and the core fixing part 340. That is, the degree of relative position accuracy between the case fixing part 320 and the core fixing part 340 is considerably low in comparison with the conventional configuration in which the stay is used. Therefore, it becomes necessary to increase the gap G (see FIG. 5) to secure non-contact between the reactor body 1*a* and the radiation case 50. As a result, the reactor employing the case fixing part 320 is not able to achieve a high degree of heat radiation property.

On the other hand, although the core fixing member 30 according to the embodiment shown in FIG. 6 is also configured such that the case fixing part 32 is connected to the core fixing part 34 via two bending processing parts A1 and A2, processing errors of the bending processing parts A1 and A2 mainly affect inclination of the arm (joint part) 36 with respect to the case fixing part 34 and the core fixing part 36, and the relative position accuracy of the case fixing part 32 and the core fixing part 36 is determined by a difference between processing amounts (bending angles) of the two bending processing parts A1 and A2. The bending processing parts A1 and A2 can be formed under substantially the same condition through a single processing, the difference between the processing amounts of the bending processing parts A1 and A2 is sufficiently small in comparison with an error of the bending processing amount for one point. Furthermore, in the core fixing member 30, the case fixing part 32 and the core fixing part 34 are connected with the pair of arms 36 arranged in parallel. Therefore, a high degree of relative position accuracy between the case fixing part 32 and the core fixing part 34 can be secured.

Next, the procedure of assembling of the reactor 1*a* and the fixing of the reactor body 1*a* to the radiation case 50 with the core fixing member 30 are explained.

In the assembling of the reactor body 1*a*, first, the straight parts of the U-shaped core unit 20*a* are inserted into the two winding parts of the coil 10, and the end faces of the pair of U-shaped core units 20*a* are set to confront with respect to each other and are adhered to each other. Next, the adhered pair of U-shaped core units 2*a* are attached to a desiccated fixture (not shown) so that the adhesion fixes, while maintaining the U-shaped core units 2*a* at a predetermined temperature and applying a certain adhesion pressure in the X axis direction. When the adhesion fixes, the core 20 is removed from the fixture, and the core fixing member 30 is attached to the core 20 with the two bolts 42. Specifically, the bolt 42 is inserted into the through hole 34*h* of the core fixing part 34 of the core fixing member 30, and thereafter the bolt 42 is screwed into the nut 22 buried into the bracket 21 of the core 20. Thus, the core fixing member 30 is attached to the core 20.

Next, the reactor body 1*a* to which the core fixing member 30 is attached is attached to the radiation case 50 with the bolt 44. Specifically, the bolt 44 is inserted into the though hole 32*h* formed in the case fixing part 32 of each core fixing member 30, and thereafter the bolt 44 is screwed into a female screw 52*m* formed in a mounting base 52 formed in the radiation case 50, so that the reactor body 1*a* is attached to the radiation case 50. Next, the terminal base 60 is fixed to the radiation case 50 with the bolts 72, and bus bars 62 and 64 and the leads 12 and 14 of the coil 10 are joined together, for example, through welding. Finally, the radiation case 50 is filled with the filler 80, such as silicon resin or epoxy resin having an insulating property and a high degree of thermal conductivity, and thus the reactor 1 is completed.

As shown in FIG. 5, the U-shaped core unit 20*a* is formed such that the core pieces 20*c* and 20*d* stacked in the X axis direction via the gap members 20*g* are coated with resign through the insertion molding. Therefore, the degree of size accuracy in the X axis direction is relatively low. Since the core 20 is formed such that the U-shaped core units 20*a* are adhered to each other via the gap member 20*g*, the size accuracy in the X axis direction is considerably lower than the size accuracy in the Y axis direction. Furthermore, the heat expansion and the amplitude of the vibration of the core 20 become the maximum in the X axis direction. However, the core fixing member 30 has the slender arm 36 having elasticity, and therefore is formed to be flexible in regard to deformation in all directions. Furthermore, since the core fixing member 30 functions as a spring having a low spring constant (i.e., a low characteristic frequency), the vibration caused by the coil 20 having the frequency higher than the audio frequency is hard to propagate to the radiation case 50, and thereby the noise caused by the reactor 1 reduces. The core fixing member 30 has the connecting part connecting the fixing parts longer than that of the conventional stay, and the distance along which the vibration propagates from the core 20 to the radiation case 50 is longer than that of the conventional stay. Therefore, the attenuation rate of the vibration propagating through the core fixing member 30 becomes large.

The core fixing member 30 is configured such that only the core fixing parts 34 contact the core 20, and the case fixing part 32 and the arms 36 do not contact the core 20. With this configuration, it becomes possible to secure a long path along which the vibration propagates from the core 20 to the radiation case 50, and thereby to enhance the effect of reducing the vibration by the arms 36. Furthermore, such a configuration makes it possible to secure a long effective length of the arm 36 functioning as a spring for supporting the core 20. Therefore, a low characteristic frequency of the arm 36 can be secured, and thereby the propagation of the high frequency vibration causing noise to the radiation case 50 can be effectively suppressed.

FIG. 5 is a cross section viewed along a line passing through center axes of the pair of nuts 22, which are arranged to sandwich the core 20 in the X axis direction, of the four nuts 22 buried in the bracket 21 for fixing the core 20 to the core fixing member 30 with bolts. As shown in FIG. 5, on a straight line L connecting the centers of the pair of nuts 22, the core pieces 20*c* and the gap member 20*g* are arranged with no space. Therefore, the major part of the force applied in the X axis direction from the core fixing member 30 to the core 20 via each nut 22 propagates, as a compressing force or a drawing force, along the straight line L in the core 20 without change. Therefore, a strong shearing force is not caused in the core 20. Therefore, even if a dust core having a low shear strength is used as the core 20, no crack is caused in the core 20 by a force received from the core fixing member 30.

On the other hand, if the pair of nuts 22 each having a shape of a letter 'O' are provided at the central portion in the Y axis direction of the core 20, a region (a hollow part of the core 20 having a shape of a letter 'O') in which the core 20 does not exist appears along a line connecting the centers of the pair of nuts 22. In such a configuration, when the core fixing member 30 applies a force in the X axis direction to the core via the nuts 22, a strong shearing force is applied to the core 20. Therefore, such a configuration is not appropriate for use of core material having a low shear strength, such as a dust core.

Hereafter, the arrangement of the bus bars 62 and 64 of the terminal base 60 and the leads 12 and 14 of the coil 10 is explained with reference to FIGS. 7 and 8. FIG. 7 generally illustrates the arrangement of the bus bar 62 of the terminal base 60 and the lead 12 of the coil 10 according to the embodiment. FIG. 8 illustrates the arrangement of a bus bar 62*a* and a lead 12*a* according to another example of the embodiment of the invention. The spring constant of the conventional leaf spring type core fixing member has a certain degree of fluctuations. Therefore, in the configuration where the core is pinched in the X axis direction with the conventional leaf spring type core fixing member, the position of the core in the X axis direction shifts from an original design position due to disbalance of the load applied to the core from each core fixing member. Therefore, as shown in FIG. 8, if the tip part at which the bus bar 62*a* and the lead 12*a* are welded is bent in the direction (the Z axis direction in FIG. 8) perpendicular to the X axis direction, the lead 12*a* is located at the position indicated by a dashed line if the position of the core shifts from the design position toward the positive direction of the X axis. In this case, since the lead 12*a* is not able to contact the bus bar 62*a*, the lead 12*a* and the bus bar 62*a* cannot be welded. Therefore, if the conventional leaf spring type core fixing member is used, the designer has no choice but to accept the configuration where the tip parts of the bus bar 62 and the lead 12 are extended in the X axis direction. On the other hand, when the core 20 is attached to the radiation case 50 with the core fixing member 30 according to the embodiment, a strong force does acts on the core fixing member 30 in the X axis direction and therefore almost no deformation is caused in the X axis direction. Therefore, even when the spring constants of the core fixing members 30 are different from each other, the position of the core 20 does not deviate largely from the design position. Accordingly, when the core fixing member 30 is employed, the configuration in which the welding parts of the lead 12*a* and the bus bar 62*a* are extended in the direction perpendicular to the Y axis direction can be employed. That is, according to the embodiment of the invention, a high degree of design freedom can be obtained.

As shown in FIG. 6, the core fixing member 30 has such a simple structure that the core fixing member 30 consists only of the case fixing part 32, the pair of core fixing parts 34 and the two pairs of arms 36. Furthermore, since the core fixing member 30 can be formed through a simple process in which a metal plate formed by punching to have a predetermined shape is bent at four points in the same direction by 90 degrees, the core fixing member 30 can be manufactured at a low cost. Since, according to the embodiment, the core 20 can be fixed in the radiation case 50 with a high degree of accuracy by only bolting each core fixing member 30 to the radiation case 50 at three points (i.e. by only bolting the core fixing members 30 to the radiation case 50 at six points). Therefore, the processing cost required for assembling the reactor 1 can also be reduced. Since normally the core fixing member 30 is attached to the radiation case 50 without applying a load on the core fixing member 30, there is no necessity to calculate a load balance in designing of a reactor, and therefore excessive work is not required. Furthermore, since there is no necessity to tighten up the size accuracy of the core fixing member 30 to secure the load balance, the core fixing member 30 can be manufactured at a low cost.

Although the present invention has been described in considerable detail with reference to certain preferred embodiments thereof, other embodiments are possible.

In the above described embodiment, each core fixing part 34 is connected to the case fixing part 32 with the pair of arms 36. However, the core fixing part 34 and the case fixing part 32 may be connected with a single arm 36 as shown as a variation in FIG. 9. Although a core fixing member 30A shown in FIG. 9 is formed to have a lower degree of size accuracy in comparison with the core fixing member 30 according to the embodiment, the core fixing member 30A has the vibration relaxation property superior to that of the core fixing member 30 according to the embodiment. Furthermore, since the core fixing member 30 according to the embodiment has a higher degree of rigidity and a higher degree of size accuracy (i.e., the heat radiation property) than those of the core fixing member 30A shown in FIG. 9, the core fixing member 30 according to the embodiment is well suited for fixing of a large capacity reactor having a heavy weight and having a large heat release value. When the core fixing member 30A shown as a variation in FIG. 9 is used, the arm 36 may be oriented to the core 20 side or to the radiation case 50 side.

In the core fixing member 30 according to the embodiment, all the arms 36 are bent at a right angle toward the upper side. However, the arms 36 may be oriented toward the lower side. Alternatively, a part of the arms 36 may be oriented toward the upper side and the other part of the arms 36 may be oriented toward the lower side. The bending angle of the arm 36 is not limited to the right angle, but may be set for any angle (0° to 180°).

In the above described embodiment, the core fixing member 30 has one case fixing part 32, two core fixing parts 34 and two pairs of arms 36. However, the number of these parts is not limited to the above described embodiment. The number of these parts may be set for various types of values. For example, in another embodiment, the core fixing member 30 may have one core fixing part and two case fixing parts. The case fixing part 32 and/or the core fixing part 34 may be provided with a plurality of through holes 32*h* and/or 34*h*.

The above described embodiment is an example in which the present invention is applied to a reactor. However, the present invention can also be applied to another type of coil devices, such as a transformer.

This application claims priority of Japanese Patent Applications No. 2011-015781, filed on Jan. 27, 2011. The entire subject matter of the application is incorporated herein by reference.

What is claimed is:

1. A core fixing member for fixing a core of a coil device body to a case to accommodate the coil device body in the case in a non-contact manner, the core fixing member comprising:

a core fixing part that has a plate-like shape and is to be fixed to the core; a case fixing part that has a plate-like shape and is to be fixed to the case; and at least one arm part connecting the case fixing part with the core fixing part, wherein the at least one arm part has a pair of projections arranged between the core fixing part and the case fixing part in an arrangement direction in which the core fixing part and the case fixing part are arranged and formed to project in a direction perpendicular to the arrangement direction;

the core fixing part and the case fixing part are arranged in a same plane; and the at least one arm part is formed in a shape of a letter 'U', and one end of the at least one arm part is connected to the core fixing part and the other end of the at least one arm part is connected to the case fixing part.

2. The core fixing member according to claim 1, wherein the core fixing member is made from a sheet of metal plate.

3. The core fixing member according to claim 1, wherein the at least one arm part is formed such that the pair of projections are bent at a predetermined angle with respect to the same plane in which the core fixing part and the case fixing part are arranged.

4. The core fixing member according to claim 3, wherein the at least one arm part is formed such that the pair of projections are bent at an approximately right angle with respect to the same plane in which the core fixing part and the case fixing part are arranged.

5. The core fixing member according to claim 3, wherein the at least one arm part has a same width at bending portions of the pair of projections.

6. The core fixing member according to claim 1, wherein each of the core fixing part and the case fixing part has a recessed part having a curved contour at a connecting portion with respect to the at least one arm part.

7. The core fixing member according to claim 1, wherein:

the at least one arm part comprises a pair of arm parts; and the core fixing part is connected with the case fixing part by the pair of arm parts arranged to be sandwiched by the core fixing part and the case fixing part.

8. The core fixing member according to claim 1, wherein each of the core fixing part and the case fixing part has a through hole formed therein for bolting.

9. A coil device, comprising:

a coil device body having a core;

a case in which the coil device body is accommodated in a non-contact manner; and a core fixing member provided to fix both ends of the core to the case, the core fixing member comprising:

a core fixing part that has a plate-like shape and is fixed to the core; a case fixing part that has a plate-like shape and is fixed to the case; and at least one arm part connecting the case fixing part with the core fixing part, wherein the at least one arm part has a pair of projections arranged between the core fixing part and the case fixing part in an arrangement direction in which the core fixing part and the case fixing part are arranged and formed to project in a direction perpendicular to the arrangement direction;

the core fixing part and the case fixing part are arranged in a same plane; and the at least one arm part is formed in a shape of a letter 'U', and one end of the at least one arm part is connected to the core fixing part and the other end of the at least one arm part is connected to the case fixing part.

10. The coil device according to claim 9, wherein:

the case is a heat radiation case configured to direct heat of the coil device body to an outside to release the heat to the outside; and a gap between the heat radiation case and the coil device body is filled with a filler.

11. The coil device according to claim 9, wherein:

the core is provided with a pair of nuts for bolting the core fixing part, at both ends thereof in a certain direction; the core is formed to continuously extend between the pair of nuts.

12. The coil device according to claim 11, wherein the core is a dust core.

13. The coil device according to claim 11, wherein the coil device is a reactor.

14. The coil device according to claim 9, wherein the core fixing member is made from a sheet of metal plate.

15. The coil device according to claim 9, wherein the at least one arm part is formed such that the pair of projections are bent at a predetermined angle with respect to the same plane in which the core fixing part and the case fixing part are arranged.

16. The coil device according to claim 15, wherein the at least one arm part is formed such that the pair of projections are bent at an approximately right angle with respect to the same plane in which the core fixing part and the case fixing part are arranged.

17. The coil device according to claim 15, wherein the at least one arm part has a same width at bending portions of the pair of projections.

18. The coil device according to claim 9, wherein each of the core fixing part and the case fixing part has a recessed part having a curved contour at a connecting portion with respect to the at least one arm part.

* * * * *